US008177314B2

(12) United States Patent
Usuda et al.

(10) Patent No.: US 8,177,314 B2
(45) Date of Patent: May 15, 2012

(54) PRINTING APPARATUS AND METHOD OF SWITCHING FILLED STATES

(75) Inventors: Hidenori Usuda, Matsumoto (JP); Koji Harada, Matsumoto (JP); Yoshiaki Shimizu, Matsumoto (JP); Toshio Kumagai, Shiojiri (JP); Shinji Hirata, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 169 days.

(21) Appl. No.: 12/794,282

(22) Filed: Jun. 4, 2010

(65) Prior Publication Data

US 2010/0309239 A1 Dec. 9, 2010

(30) Foreign Application Priority Data

Jun. 5, 2009 (JP) ..... 2009-136601

(51) Int. Cl.
*B41J 2/195* (2006.01)

(52) U.S. Cl. ..... 347/7

(58) Field of Classification Search ..... 347/5–7
See application file for complete search history.

(56) References Cited

U.S. PATENT DOCUMENTS 6,799,820 B1 * 10/2004 Usui et al. ..... 347/7
6,930,135 B2 8/2005 Chung et al.
7,306,308 B2 * 12/2007 Tsukada et al. ..... 347/7

FOREIGN PATENT DOCUMENTS

JP 2003-313481 11/2003
JP 2008-162023 7/2008

* cited by examiner

*Primary Examiner* — An Do
(74) *Attorney, Agent, or Firm* — Workman Nydegger

(57) ABSTRACT

A printing apparatus includes a head which discharges color inks and into which clear ink that prevents the head from being clogged and white ink are selectively filled. A selection portion communicates either of a white or a clear ink container with the head. A controller executes a first switching from a second filled state where the head is filled with clear ink to a first filled state where the head is filled with white ink by shifting from a state where the clear ink container is communicated with the head to a state where the white ink container is communicated with the head. A second switching is executed from the first filled state to the second filled state by shifting from a state where the white ink container is communicated with the head to a state where the clear ink container is communicated with the head.

2 Claims, 8 Drawing Sheets

PRINTING APPARATUS AND METHOD OF SWITCHING FILLED STATES

CROSS-REFERENCE TO RELATED APPLICATION

The entire disclosure of Japanese Patent Application No. 2009-136601, filed Jun. 5, 2009 is expressly incorporated by reference herein.

BACKGROUND

1. Technical Field

The present invention relates to a printing apparatus and a method of switching filled states.

2. Related Art

A printing apparatus which includes a head for discharging a plurality of color inks onto a medium has been already well known. As such printing apparatuses, ink jet printers which discharge ink onto various types of media such as a sheet, a fabric, and a film, etc., and perform white color printing (printing with white ink) in addition to monochrome printing and color printing have been known.

Among such ink jet printers, there is an ink jet printer which includes a head into which white ink and clear ink are selectively filled. The clear ink is filled into the head for preventing the head from being clogged. In order to realize such selective filling, the ink jet printer includes a white ink container which contains white ink, a clear ink container which contains clear ink and a selection portion which communicates either of the white ink container or the clear ink container with the head.

JP-A-2008-162023 is an example of related art.

In the above ink jet printer, a first switching is executed in order to fill the head with white ink and a second switching is executed in order to fill the head with clear ink. In the first switching, a second filled state where the head is filled with clear ink is switched to a first filled state where the head is filled with white ink. In the second switching, the first filled state is switched to the second filled state. At this time, the first switching is executed by operating the selection portion so as to shift from a state where the clear ink container is communicated with the head to a state where the white ink container is communicated with the head, and then, consuming ink from the head. On the other hand, the second switching is executed by operating the selection portion so as to shift from a state where the white ink container is communicated with the head to a state where the clear ink container is communicated with the head, and then, consuming ink from the head.

In this manner, ink is consumed from the head at the time of switching. However, the ink consumed at these times is desirably suppressed to a minimum amount as possible.

SUMMARY

An advantage of some aspects of the invention is to save clear ink.

According to an aspect of the invention, a printing apparatus includes a head which discharges a plurality of color inks onto a medium and into which white ink and clear ink which is for preventing the head from being clogged are selectively filled, a white ink container which contains white ink, a clear ink container which contains clear ink, a selection portion which communicates either of the white ink container or the clear ink container with the head, and a controller. In the printing apparatus, the controller executes a first switching from a second filled state where the head is filled with clear ink to a first filled state where the head is filled with white ink by operating the selection portion so as to shift from a state where the clear ink container is communicated with the head to a state where the white ink container is communicated with the head, and then, consuming ink for a first predetermined amount from the head. Further, the controller also executes a second switching from the first filled state to the second filled state by operating the selection portion so as to shift from a state where the white ink container is communicated with the head to a state where the clear ink container is communicated with the head, and then, consuming ink for a second predetermined amount which is smaller than the first predetermined amount from the head.

Another characteristics of the invention will be made obvious from description of the specification and accompanying drawings.

BRIEF DESCRIPTION OF THE DRAWINGS

The invention will be described with reference to the accompanying drawings, wherein like numbers reference like elements.

FIG. 7 is a flowchart illustrating an example of a white switching executed by a controller after power is turned ON.

DESCRIPTION OF EXEMPLARY EMBODIMENTS

At least the following matters are made obvious from the specification and accompanying drawings.

A printing apparatus includes a head which discharges a plurality of color inks onto a medium and into which white ink and clear ink which is for preventing the head from being clogged are selectively filled, a white ink container which contains white ink, a clear ink container which contains clear ink, a selection portion which communicates either of the white ink container or the clear ink container with the head; and a controller. In the printing apparatus, the controller executes a first switching from a second filled state where the head is filled with clear ink to a first filled state where the head is filled with white ink by operating the selection portion so as to shift from a state where the clear ink container is communicated with the head to a state where the white ink container is communicated with the head, and then, consuming ink for a first predetermined amount from the head. Further, the controller also executes a second switching from the first filled state to the second filled state by operating the selection portion so as to shift from a state where the white ink container is communicated with the head to a state where the clear ink container is communicated with the head, and then, consuming ink for a second predetermined amount which is smaller than the first predetermined amount from the head.

With the above printing apparatus, clear ink can be saved.

A method of switching filled states includes executing a first switching from a second filled state where a head, which discharges a plurality of color inks onto a medium and into which white ink and clear ink which is for preventing the head from being clogged are selectively filled, is filled with clear ink to a first filled state where the head is filled with white ink by operating a selection portion, which communicates either of a white ink container or a clear ink container with the head, so as to shift from a state where the clear ink container is communicated with the head to a state where the white ink container is communicated with the head, and then, consuming ink for a first predetermined amount from the head, and executing a second switching from the first filled state to the second filled state by operating the selection portion so as to shift from a state where the white ink container is communicated with the head to a state where the clear ink container is communicated with the head, and then, consuming ink for a second predetermined amount which is smaller than the first predetermined amount from the head.

With the above method of switching filled states, clear ink can be saved.

Printer 1 According to an Embodiment of the Invention

At first, a schematic configuration of the printer 1 according to the embodiment of the invention is described with reference to FIG. 1 to FIG. 6.

Figure 1:
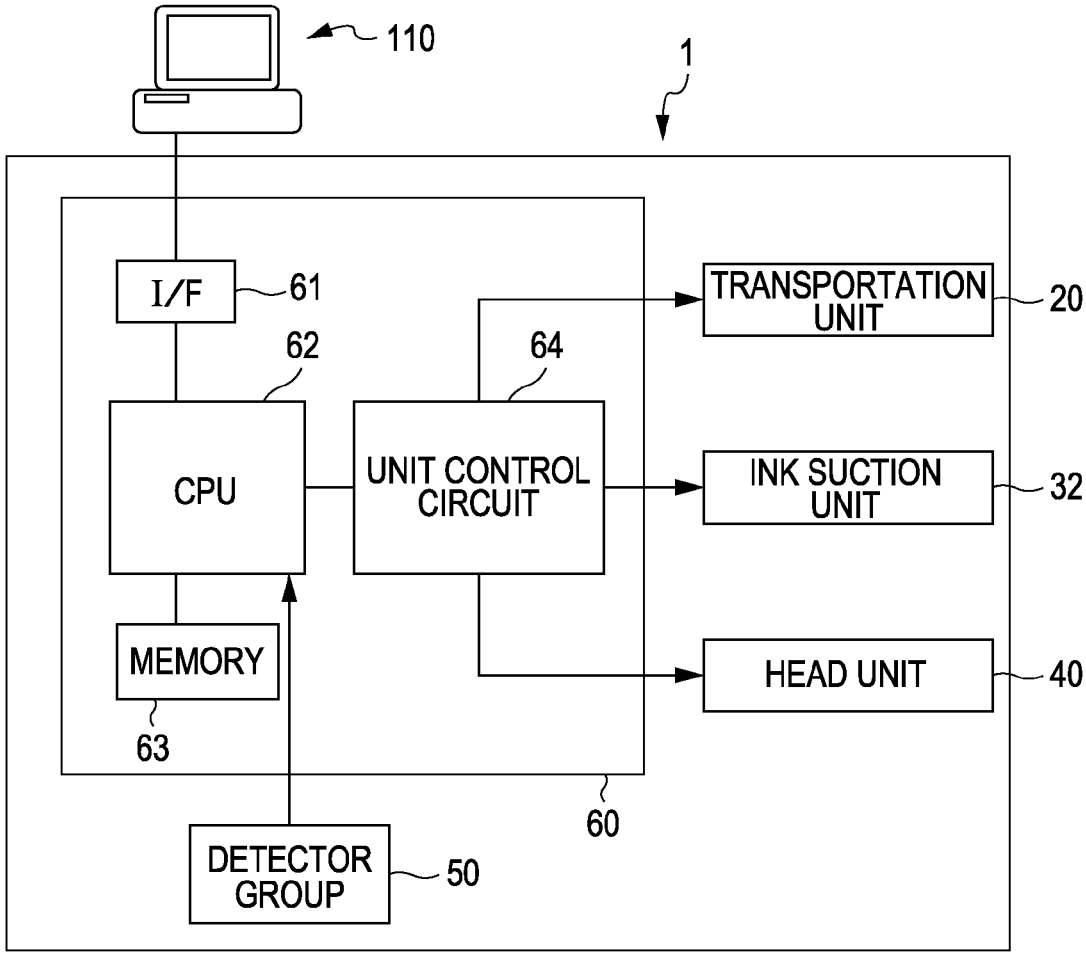
FIG. 1 is a block view illustrating a printer according to an embodiment of the invention.
Figure 2:
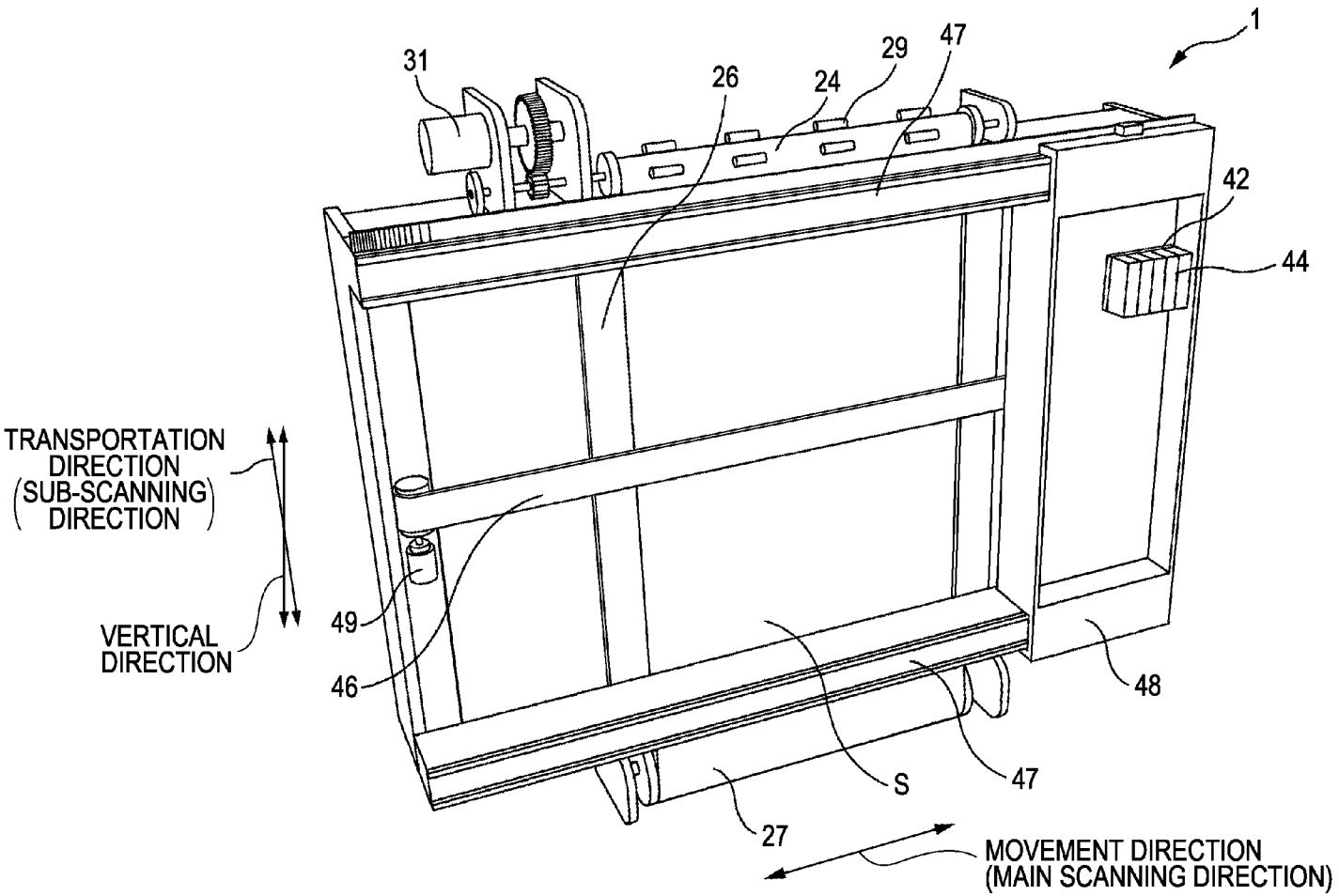
FIG. 2 is a perspective view illustrating a schematic configuration of the printer.
Figure 3:
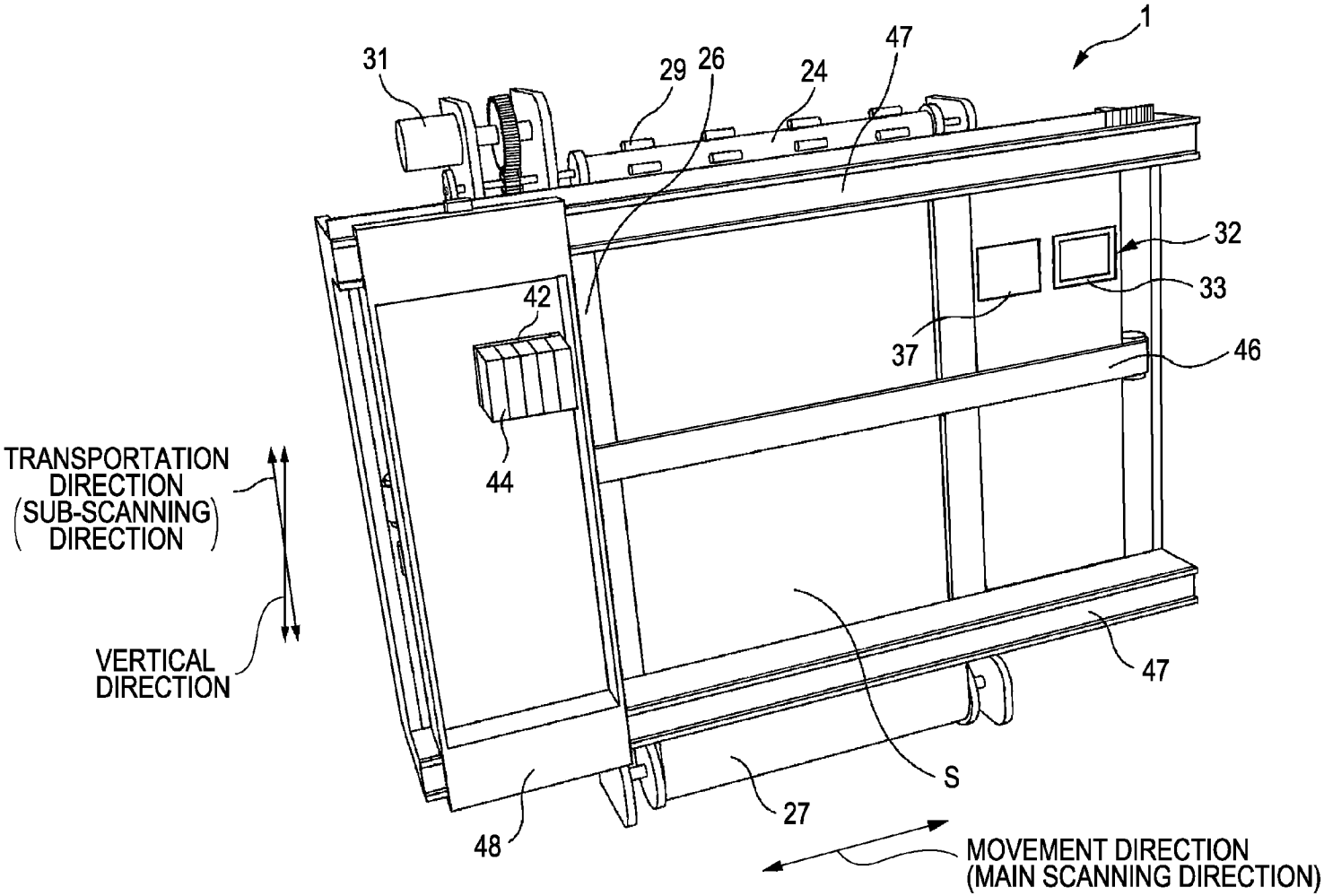
FIG. 3 is a perspective view illustrating a schematic configuration of the printer.
Figure 4:
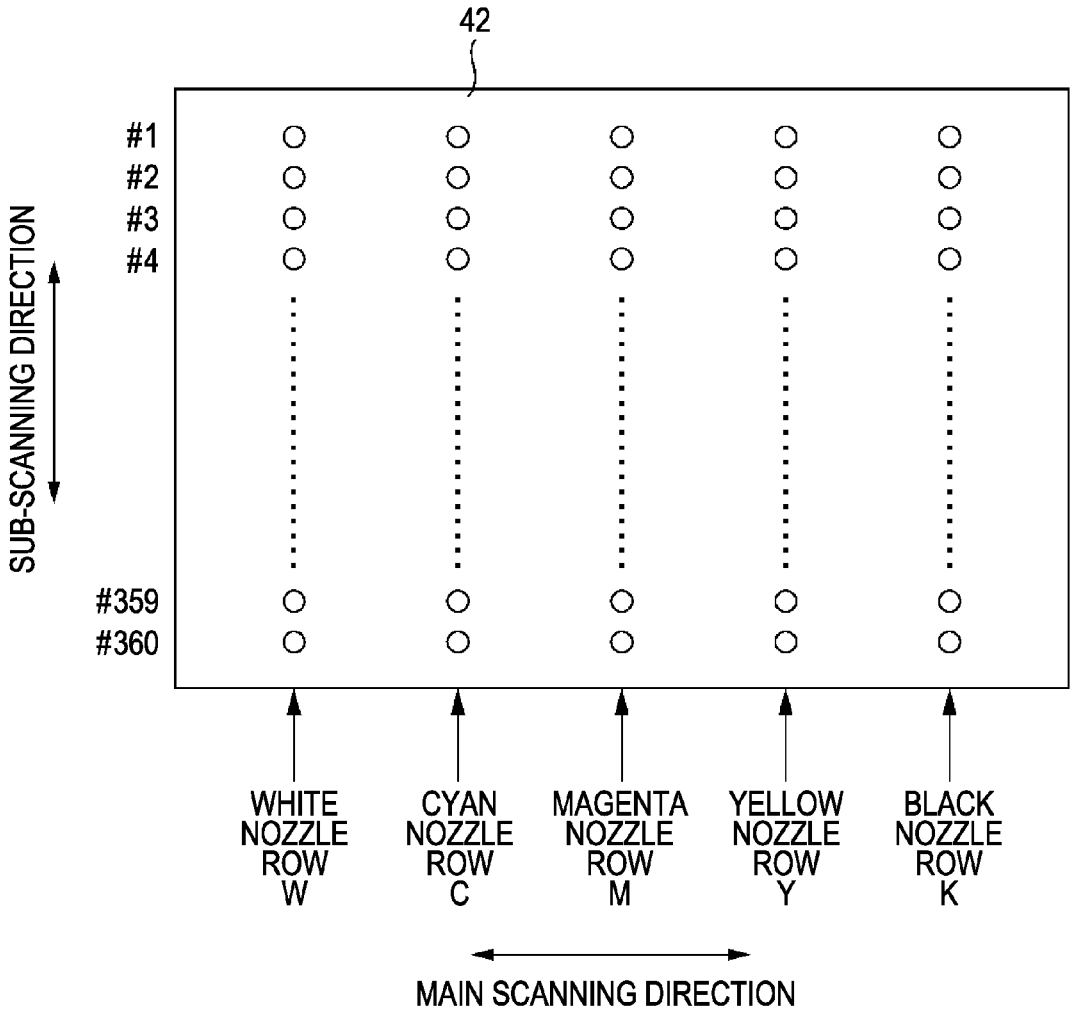
FIG. 4 is a conceptual view illustrating nozzle rows formed on a head.
Figure 5A:
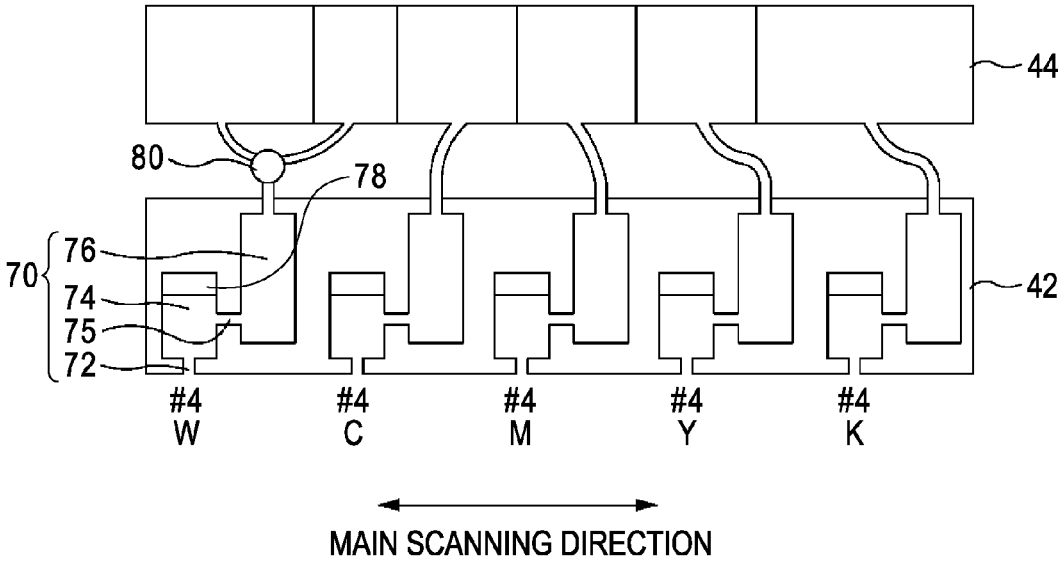
FIG. 5A is a conceptual view illustrating filled chambers of the head and ink cartridges.
Figure 5B:
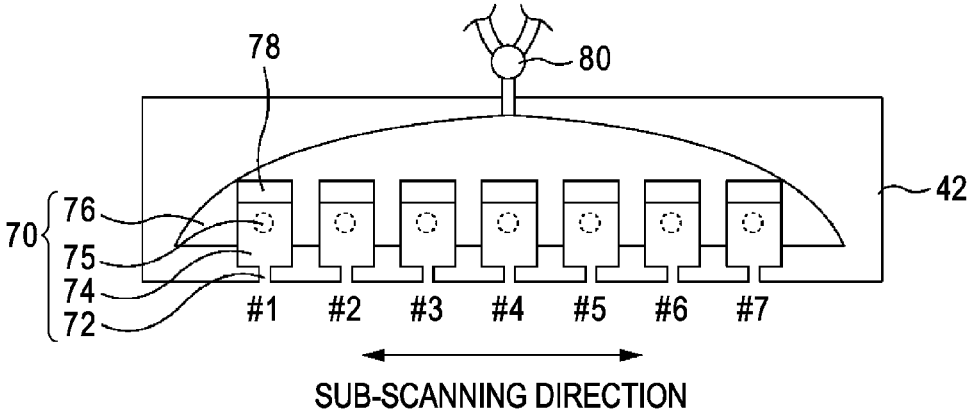
FIG. 5B is a conceptual view illustrating the filled chambers of the head.
Figure 6:
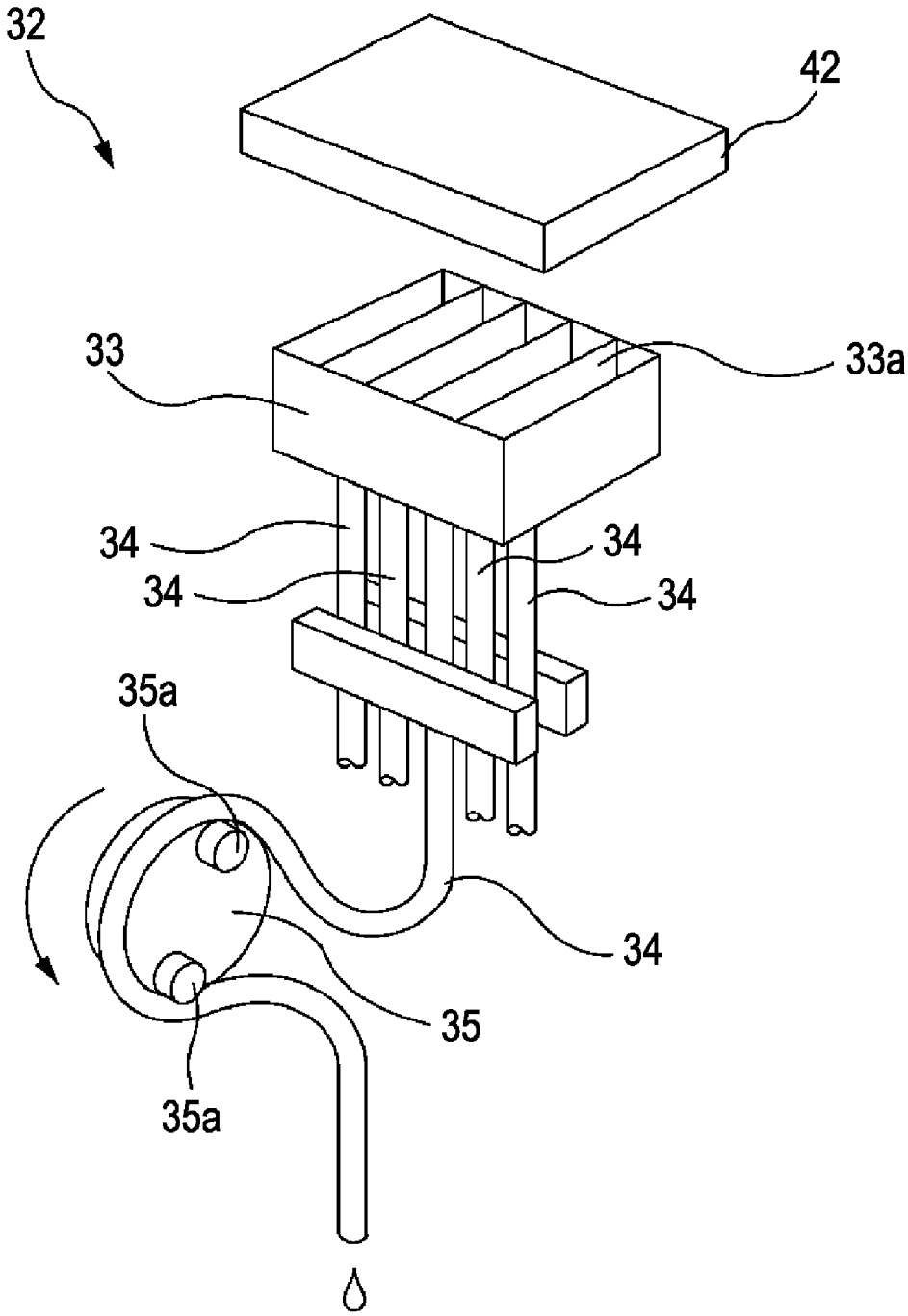
FIG. 6 is a conceptual view illustrating an ink suction unit.

FIG. 1 is a block view illustrating an ink jet printer (hereinafter, also referred to as printer 1) as an example of printing apparatuses according to the embodiment of the invention. FIG. 2 and FIG. 3 are perspective views illustrating a schematic configuration of the printer 1. FIG. 4 is a conceptual view illustrating nozzle rows formed on a head 42. FIG. 5A is a conceptual view illustrating filled chambers 70 of the head 42 and ink cartridges 44. FIG. 5B is a conceptual view illustrating the filled chambers 70 of the head 42. FIG. 6 is a conceptual view illustrating an ink suction unit 32.

The printer 1 as shown in FIG. 2 is different from the printer 1 as shown in FIG. 3 in the position of a carriage 48 which will be described later. In FIG. 5A and FIG. 5B, the number of each of nozzles 72, pressure chambers 74 and piezoelectric devices 78 is illustrated to be seven which is less than the actual number (360) in order to make the drawings simple. In FIG. 6, only one of five suction pumps 35 is illustrated (four suction pumps 35 are not illustrated) in order to make the drawing simple.

For example, the printer 1 supports a roll sheet and a large-sized print sheet (which correspond to media). In examples as shown in FIG. 2 and FIG. 3, a roll sheet S is set on the printer 1. As shown in FIG. 1, the printer 1 includes a transportation unit 20, a head unit 40, the ink suction unit 32, a detector group 50 and a controller 60. The printer 1 which has received print data (print instruction) from a computer 110 as an external device controls each unit (transportation unit 20, head unit 40, and the like) with the controller 60. For example, the controller 60 receives print data (print instruction) from the computer 110, controls each unit based on the received print data (print instruction) and prints an image onto the roll sheet S. The state in the printer 1 is monitored by the detector group 50. The detector group 50 outputs the detection result to the controller 60. The controller 60 controls each unit based on the detection result output from the detector group 50.

The transportation unit 20 is a unit for transporting the roll sheet S in the transportation direction. The transportation unit 20 includes a sheet feeding motor 31, a SMAP roller 24, a roll sheet holder 27, a sheet press roller 29 and a platen 26. The SMAP roller 24 is driven by the sheet feeding motor 31 so as to transport the roll sheet S in the transportation direction (hereinafter, also referred to as sub-scanning direction). The roll sheet holder 27 is a unit for setting the roll sheet S thereon. The sheet press roller 29 presses the roll sheet S against the SMAP roller 24. The platen 26 supports the roll sheet S.

The roll sheet S is set on the roll sheet holder 27. The roll sheet S is pressed against the SMAP roller 24 by the sheet press roller 29. Then, the roll sheet S is transported on a surface of the platen 26 in the transportation direction due to a rotation of the SMAP roller 24.

The head unit 40 is a unit for discharging ink (ink conceptually includes both water soluble ink and oil based ink, and the water soluble ink is used in the embodiment of the invention) onto the roll sheet S. The head unit 40 includes the head 42, the ink cartridges 44, the carriage 48, a carriage motor 49, a towing belt 46 and a guide rail 47. The ink cartridge 44 is an example of containers for containing ink to be supplied to the head 42. The carriage 48 supports the head 42 so as to move the head 42 in the movement direction (hereinafter, also referred to as main scanning direction). The towing belt 46 is driven by the carriage motor 49 so as to move the carriage 48. The guide rail 47 guides the carriage 48. The carriage 48 is towed by the towing belt 46 which is driven by the carriage motor 49 so as to move along the guide rail 47 in the main scanning direction. Then, dots are formed on the roll sheet S and an image is printed onto the roll sheet S by repeating the following operations. That is, an operation in which the head 42 discharges ink while the carriage 48 is moved in the main scanning direction and an operation in which the above transportation unit 20 transports the roll sheet S are repeated.

In the printer 1 according to the embodiment of the invention, white color printing (printing with white ink) can be executed in addition to normal monochrome printing and color printing. That is to say, the printer 1 includes a print mode where the white color printing is executed, a print mode where the monochrome printing is executed, and a print mode where the color printing is executed as print modes. In the print mode where the white color printing is executed, white ink is used. In the print mode where the monochrome printing is executed and the print mode where the color printing is executed, white ink is not used.

In the printer 1 according to the embodiment of the invention, white ink for the white printing and black ink, cyan ink, magenta ink and yellow ink for the monochrome printing or the color printing are prepared in order to realize the above print modes.

White ink according to the embodiment of the invention is ink described in JP-A-2003-313481, for example. The white ink is water soluble pigment ink and is characterized in that the white ink includes a hollow resin. When the hollow resin is present in liquid ink, a hollow portion (cavity) is filled with water. When the ink is discharged and placed on a medium, water in the hollow portion (cavity) is vaporized. Then, the hollow portion (cavity) is filled with the air. At this time, the size of the hollow portion (cavity) is designed such that visible light is effectively scattered (that is, such that the ink looks white). Therefore, if a user sees an image formed with the ink placed on the medium, the image looks white.

Chambers to be filled with ink (hereinafter, referred to as filled chamber 70 for convenience) are provided on the head 42 for each ink of five colors (for each color). Each filled chamber 70 includes nozzles 72, pressure chambers 74, a reservoir 76 and the like, as shown in FIG. 5A and FIG. 5B.

Each nozzle 72 is a discharge port of ink and is provided on the bottom face of the head 42. As shown in FIG. 4, 360 nozzles 72 are provided for each ink of five colors (for each color). That is, 360 nozzles from which white ink is discharged, 360 nozzles from which cyan ink is discharged, 360 nozzles from which magenta ink is discharged, 360 nozzles from which yellow ink is discharged and 360 nozzles from which black ink is discharged (360×5=1800 nozzles in total) are provided. 360 nozzles for each color are arranged along the sub-scanning direction in row so as to form each of a white nozzle row W, a cyan nozzle row C, a magenta nozzle row M, a yellow nozzle row Y, and a black nozzle row K.

Each pressure chamber 74 is a chamber communicating with each nozzle 72 as shown in FIG. 5A and FIG. 5B. A driving device (piezoelectric device 78) for discharging ink is provided at a position adjacent to each pressure chamber 74. At the time of printing, the piezoelectric device 78 expands and contracts based on a driving pulse contained in the driving signal output from a unit control circuit 64. Then, a volume of the pressure chamber 74 is changed with the expansion and contraction so that ink is discharged from each nozzle 72.

The pressure chamber 74 (and also piezoelectric device 78) are provided for each nozzle 72. Therefore, as the pressure chambers 74 according to the embodiment of the invention, 360 white ink pressure chambers, 360 cyan ink pressure chambers, 360 magenta ink pressure chambers, 360 yellow ink pressure chambers, and 360 black ink pressure chambers (360×5=1800 chambers in total) are provided. As described above, the number of each of nozzles 72, pressure chambers 74 and piezoelectric devices 78 is illustrated to be seven which is less than the actual number (360) in FIG. 5A and FIG. 5B. In FIG. 5A, illustrated starting from the left are No. 4 nozzle from which white ink is discharged and the pressure chamber 74 and the piezoelectric device 78 corresponding to the No. 4 nozzle, No. 4 nozzle from which cyan ink is discharged and the pressure chamber 74 and the piezoelectric device 78 corresponding to the No. 4 nozzle, No. 4 nozzle from which magenta ink is discharged and the pressure chamber 74 and the piezoelectric device 78 corresponding to the No. 4 nozzle, No. 4 nozzle from which yellow ink is discharged and the pressure chamber 74 and the piezoelectric device 78 corresponding to the No. 4 nozzle, and No. 4 nozzle from which black ink is discharged and the pressure chamber 74 and the piezoelectric device 78 corresponding to the No. 4 nozzle. On the other hand, in FIG. 5B, illustrated starting from the left are No. 1, No. 2, No. 3, . . . No. 7 nozzles and the pressure chambers 74 and the piezoelectric devices 78 corresponding to these nozzles.

Each reservoir 76 is a chamber communicating with the pressure chambers 74 through supply paths 75 as shown in FIGS. 5A and 5B. Each reservoir 76 for storing ink is provided for each ink of five colors (for each color). That is, a white ink reservoir, a cyan ink reservoir, a magenta ink reservoir, a yellow ink reservoir and a black ink reservoir are provided in the embodiment of the invention. Each reservoir 76 communicates with 360 pressure chambers 74. In FIG. 5A, illustrated starting from the left are the white ink reservoir, the cyan ink reservoir, the magenta ink reservoir, the yellow ink reservoir, and the black ink reservoir. On the other hand, only the white ink reservoir is illustrated in FIG. 5B.

In this manner, the filled chamber 70 including one reservoir 76, 360 pressure chambers 74 and 360 nozzles 72 is provided on the head 42 for each ink of five colors (for each color). That is to say, a white ink filled chamber filled with white ink, a cyan ink filled chamber filled with cyan ink, a magenta ink filled chamber filled with magenta ink, a yellow ink filled chamber filled with yellow ink and a black ink filled chamber filled with black ink are provided in the embodiment of the invention.

As shown in FIG. 5A, the ink cartridges 44 are detachably connected to the head 42 (to be more specific, to the reservoirs 76 of the head 42). Ink in each ink cartridge 44 is flown into (supplied to) each filled chamber 70 so as to fill the filled chamber 70 with the ink. As is also obvious from FIG. 5A, only one ink cartridge 44 is connected to each of the cyan ink filled chamber, the magenta ink filled chamber, the yellow ink filled chamber and the black ink filled chamber (that is, ink cartridge for cyan ink, ink cartridge for magenta ink, ink cartridge for yellow ink, ink cartridge for black ink). However, two ink cartridges 44 are connected to the white ink filled chamber.

The white ink filled chamber can be filled with not only white ink but also clear ink in the embodiment of the invention. In other words, the head 42 (to be more specific, the filled chamber 70) into which white ink and clear ink are selectively filled is realized in the printer 1 according to the embodiment of the invention. Therefore, two ink cartridges 44, that is, an ink cartridge for white ink in which white ink is contained and an ink cartridge for clear ink in which clear ink is contained are connected to the white ink filled chamber through a toggle switch 80 as an example of a selection portion. Note that the selection portion communicates any one of the cartridges with the head (to be more specific, the filled chamber 70). When the white ink filled chamber is communicated with the ink cartridge for white ink through the toggle switch 80, white ink is filled into the white ink filled chamber. When the white ink filled chamber is communicated with the ink cartridge for clear ink, clear ink is filled into the white ink filled chamber.

An object of the selective filling of white ink or clear ink, a specific method and an example of timing of switching from white ink to clear ink (from clear ink to white ink) will be described in detail later.

The ink suction unit 32 is a unit for sucking ink. The ink suction unit 32 is provided at a position so as to be opposed to the head 42 when the carriage 48 is located at an end in the main scanning direction as a home position as shown in FIG. 2 and FIG. 3. The ink suction unit 32 sucks ink at the time of a cleaning process for eliminating a discharge failure of the head 42 and a switching process from white ink to clear ink (clear ink to white ink). The switching process will be described in detail later. The ink suction unit 32 includes a head cap 33, hoses 34 and suction pumps 35 as shown in FIG. 6.

Inner space of the head cap 33 is divided into five suction chambers 33*a*. As the head cap 33 goes up, the head cap 33 comes into close contact with the bottom face of the head 42. At this time, each of the five suction chambers 33*a* forms a closed space covering a corresponding nozzle row among the above five nozzle rows. In other words, the head cap 33 goes up to seal the bottom face (nozzle face) of the head 42.

Each suction pump 35 has two small rollers 35*a* in the vicinity of the periphery thereof. The corresponding hose 34 is wound around the two small rollers 35*a*. When the suction pump 35 is driven by a motor (not shown) so as to be rotated in the direction of an arrow, the air in the hose 34 is pushed by the small rollers 35*a*, so that the air in the closed space in the head cap 33 is released. When the air in the closed space is released, pressure in the closed space becomes negative pressure. Then, ink is sucked from the filled chamber 70 (nozzles 72) of the head 42. The sucked ink is disposed to a waste ink disposal portion (not shown) through the hose 34.

The head cap 33 brings out the following function without the suction pump 35 being operated. That is to say, when the printer 1 does not perform printing (and the carriage 48 is located at a home position), the head cap 33 goes up and comes into close contact with the bottom face of the head 42. With this, ink is suppressed from being vaporized from the nozzles 72 (in other words, from being dried). That is to say, the head cap 33 seals the bottom face (nozzle face) of the head 42 while the printing is stopped, thereby realizing a function as a lid member for suppressing ink from being vaporized.

As shown in FIG. 3, a flushing box 37 is provided at a position adjacent to the ink suction unit 32 in the main scanning direction (at a position which is inner side than the ink suction unit 32). In the printing apparatus (printer 1), all nozzles 72 are subjected to flushing while the printing process is executed (that is, until the printer shifts to a standby state since the controller 60 has received a print instruction) and an operation where the head 42 discharges ink for printing an image is not executed. The all nozzles 72 to be subjected to flushing include the nozzles 72 which are not used for printing the image at this time. When flushing is performed, the carriage 48 is moved to a position where the head 42 is opposed to the flushing box 37. Then, when the above piezoelectric devices 78 expand and contract based on a driving pulse contained in a driving signal (which is a driving signal for flushing and is different from the driving signal for printing) output from the unit control circuit 64, the volumes of the pressure chambers 74 are changed. Then, ink is discharged toward the flushing box 37 from the nozzles 72. The ink discharged toward the flushing box 37 is disposed to the waste ink disposal portion (not shown).

The controller 60 is a control unit (control portion) for controlling the printer 1. The controller 60 has an interface portion 61, a CPU 62, a memory 63 and the unit control circuit 64. The interface portion 61 transmits and receives data between the computer 110 as an external device and the printer 1. The CPU 62 is an arithmetic processing unit for controlling the entire printer. The memory 63 ensures a region for storing programs of the CPU 62, an operation region and the like, and has a storage device such as a RAM as a volatile memory and an EEPROM as a nonvolatile memory. The CPU 62 controls each unit through the unit control circuit 64 in accordance with the programs stored in the memory 63.

Selective Filling of White Ink and Clear Ink

As described above, the filled chamber 70 (white ink filled chamber) can be filled with not only white ink but also clear ink in the embodiment of the invention. In this section, an object of the subject matter is described, at first. Next, a specific method of switching from white ink to clear ink and from clear ink to white ink is described. Subsequently, an example of timing of switching from white ink to clear ink and from clear ink to white ink is described.

Object of Selective Filling of White Ink and Clear Ink

An object of selectively filling the white ink filled chamber with white ink and clear ink is described.

The object is to prevent the head 42 (white ink filled chamber) from being clogged. That is to say, when white ink is compared with clear ink, white ink tends to cause clogging rather than clear ink, as a matter of course. Therefore, when white ink is left for a long time in a state where white ink is filled in the white ink filled chamber, the viscosity and the like of the white ink is increased. This causes clogging in the head 42 (particularly, nozzles 72). In view of the problem, in order to prevent the head 42 from being clogged, clear ink is filled into the white ink filled chamber while power is turned OFF in the embodiment of the invention (detail thereof will be described later).

Method of Switching Ink

A method of switching from white ink to clear ink and a method of switching from clear ink to white ink are described. To be precise, the method of switching from white ink to clear ink is a method of switching from a first filled state (hereinafter, also referred to as white filled state for convenience) where the head 42 is filled with white ink to a second filled state (hereinafter, also referred to as clear filled state for convenience) where the head 42 is filled with clear ink. The switching corresponds to a second switching and is also referred to as clear switching for convenience, hereinafter. On the other hand, to be precise, the method of switching from clear ink to white ink is a method of switching from the clear filled state to the white filled state. The switching corresponds to a first switching and is also referred to as white switching for convenience, hereinafter.

At the time of executing the clear switching method, at first, the controller 60 controls the head unit 40 to switch the above-described toggle switch 80. That is to say, the controller 60 operates the toggle switch 80 to shift from a state where the white ink filled chamber is communicated with the ink cartridge for white ink (hereinafter, also referred to as white communication state for convenience) to a state where the white ink filled chamber is communicated with the ink cartridge for clear ink (hereinafter, also referred to as clear communication state for convenience).

Next, the controller 60 makes ink consumed from the head 42 in the clear communication state. To be more specific, the controller 60 controls the ink suction unit 32 so as to suck ink. With this, white ink filled in the white ink filled chamber is disposed to the waste ink disposal portion. Then, clear ink is filled into the white ink filled chamber from the ink cartridge for clear ink so as to replace the white ink.

Further, at the time of executing the white switching method, at first, the controller 60 also controls the head unit 40 to switch the above-described toggle switch 80. That is to say, the controller 60 operates the toggle switch 80 to shift from the clear communication state to the white communication state.

Next, the controller 60 makes ink consumed from the head 42 in the white communication state. To be more specific, the controller 60 controls the ink suction unit 32 so as to suck ink. With this, clear ink filled in the white ink filled chamber is disposed to the waste ink disposal portion. Then, white ink is filled into the white ink filled chamber from the ink cartridge for white ink so as to replace the clear ink.

In this manner, the clear switching and the white switching are common in that the head unit 40 and the ink suction unit 32 are sequentially controlled by the controller 60 so as to sequentially execute toggling of the toggle switch 80 and the consumption of ink (suction of ink). However, the clear switching and the white switching are different from each other in the following point. That is, the controller 60 makes a consumption amount of ink (suction amount of ink) at the time of the clear switching different from a consumption amount of ink (suction amount of ink) at the time of the white switching. According to the embodiment of the invention, the controller 60 controls the ink suction unit 32 such that ink of 3.3 g is sucked at the time of the white switching. On the other hand, the controller 60 controls the ink suction unit 32 such that ink of 1 g is sucked at the time of the clear switching. In this manner, the controller 60 executes the white switching by operating the toggle switch 80 so as to shift from the clear communication state to the white communication state, and then, sucking ink for a first predetermined amount (3.3 g in the embodiment of the invention) from the head 42. On the other hand, the controller 60 executes the clear switching by operating the toggle switch 80 so as to shift from the white communication state to the clear communication state, and then, sucking ink for a second predetermined amount (1 g in the embodiment of the invention) which is smaller than the first predetermined amount from the head 42.

The first predetermined amount (3.3 g) and the second predetermined amount (1.0 g) are determined in the following way. Namely, the first predetermined amount is a suction amount such that clear ink is completely replaced with white ink by sucking ink (which is mostly clear ink) filled in the white ink filled chamber. In other words, the suction amount is an amount such that clear ink does not remain in the white ink filled chamber after ink for the first predetermined amount is sucked. On the other hand, the second predetermined amount is a suction amount such that both clear ink and white ink are mixed in the white ink filled chamber by sucking ink (which is all white ink) filled in the white ink filled chamber so as not to completely replace white ink with clear ink. At this time, both clear ink and white ink are mixed in a state in which an amount of clear ink is larger than that of white ink. In addition, in the embodiment of the invention, the first predetermined amount is an amount larger than an ink amount which can be contained in the white ink filled chamber while the second predetermined amount is an amount smaller than an ink amount which can be contained in the white ink filled chamber.

The reason why the consumption amount of ink (suction amount of ink) at the time of the clear switching and the consumption amount of ink (suction amount of ink) at the time of the white switching are made different from each other will be described later.

Timing of Switching Ink

An example of switching timing of the clear switching and the white switching is described. As described above, when power is OFF, the white ink filled chamber is set to the clear filled state in the embodiment of the invention. Schematically, the controller 60 executes the clear switching when power is turned OFF, and the controller 60 executes the white switching (returns to the white filled state) after power is turned ON.

Figure 7:
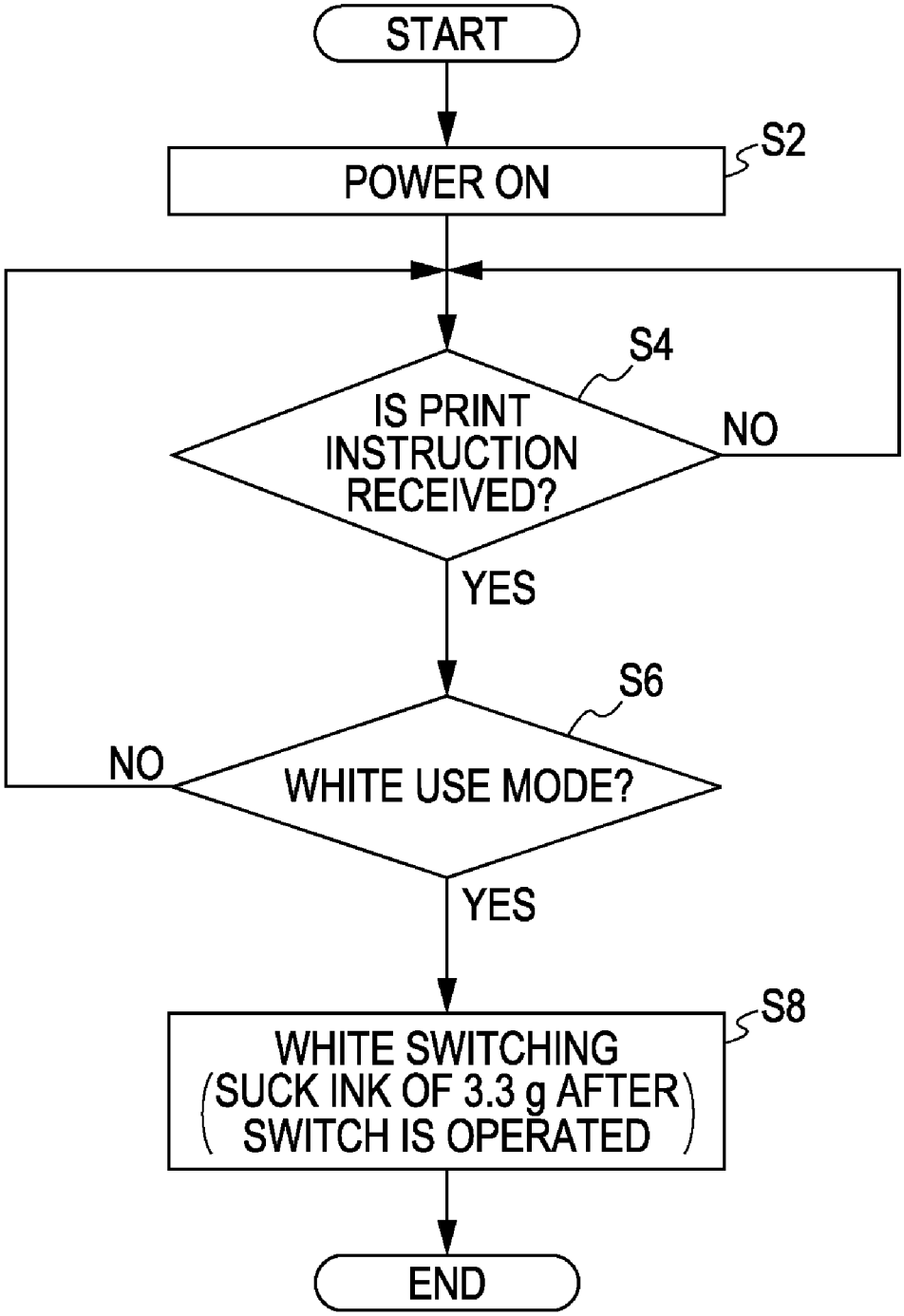
Figure 8:
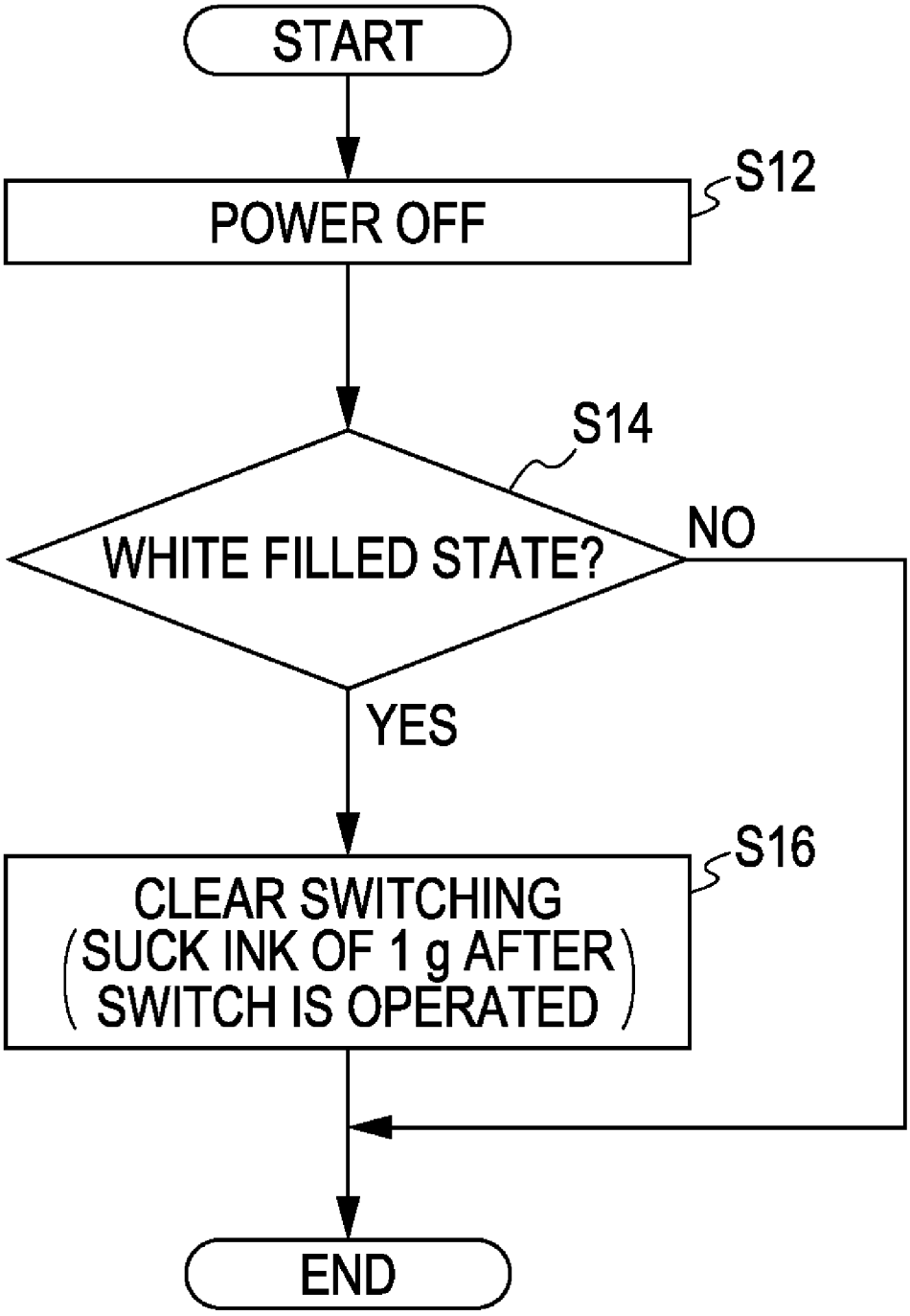
FIG. 8 is a flowchart illustrating an example of a clear switching executed by the controller when power is turned OFF.

The above system will be described in more detail below with reference to FIG. 7 and FIG. 8. FIG. 7 is a flowchart illustrating an example of the white switching executed by the controller 60 after power is turned ON. FIG. 8 is a flowchart illustrating an example of the clear switching executed by the controller 60 when power is turned OFF.

Various types of operations of the printer 1 when the switching is executed are mainly realized by the controller 60. In particular, in the embodiment of the invention, the CPU 62 processes the programs stored in the memory 63 so that the various types of operations are realized. The programs are constituted by codes for executing various types of operations which will be described later.

The example of the white switching executed by the controller 60 after power is turned ON is described, at first. The flowchart shown in FIG. 7 starts when power is turned ON by a user (step S2). As described above, clear ink is filled into the white ink filled chamber (which is in the clear filled state) while power is OFF in the embodiment of the invention. Then, when power is turned ON, the white switching is not executed and the clear filled state is maintained.

When power is turned ON, the printer 1 becomes in a standby state where the printer 1 stands by for printing (step S4: N). In such state, the white switching is not also executed and the clear filled state is maintained.

Then, after a period of time, the printer 1 (controller 60) receives a print instruction from the computer 110 (step S4: Y). When the first print instruction is received after power is turned ON, the controller 60 checks which mode of a print mode where white ink is used or a print mode where white ink is not used is indicated by the print instruction (step S6). At this time, the print mode where white ink is used is a print mode executing the white color printing (hereinafter, the mode is abbreviated to white use mode). Further, the print mode where white ink is not used is a print mode executing the monochrome printing or the color printing (hereinafter, the mode is abbreviated to white nonuse mode). Then, when the print instruction indicates the white use mode (step S6: Y), the controller 60 executes the white switching (that is, ink of 3.3 g is sucked after the toggle switch is operated) (step S8). On the other hand, when the print instruction indicates the white nonuse mode (step S6: N), the controller 60 maintains the clear filled state without executing the white switching.

When the first print instruction is received after power is turned ON, in a case where the print mode is checked and the white switching is not executed (step S6: N), the following process is executed. The controller 60 maintains the clear filled state without executing the white switching until second and subsequent print instructions are received after power is turned ON and the white use mode is checked (step S6: Y). That is to say, the controller 60 also checks the print mode as described above (step S6) when the second and subsequent print instructions are received (step S4: Y) after power is turned ON in a state where the clear filled state is maintained. The controller 60 executes the white switching (step S8) when the second and subsequent print instructions indicate the white use mode (step S6: Y). However, the controller 60 maintains the clear filled state without executing the white switching when the second and subsequent print instructions indicate the white nonuse mode (step S6: N).

Subsequently, the example of the clear switching executed by the controller 60 when power is turned OFF is described. The flowchart shown in FIG. 8 starts when power is turned OFF by a user (step S12). As described above (and as shown in FIG. 7), the white ink filled chamber can be in both the clear filled state and the white filed state while power is ON (while power is supplied to the printer 1). Accordingly, the white ink filled chamber may be in the clear filled state or the white filled state immediately before power is turned OFF.

When the controller 60 receives an instruction to turn OFF power, the controller 60 checks the state whether the white ink filled chamber is in the clear filled state or the white filled state (step S14). For example, if history of the clear switching and the white switching is set to be stored in the memory 63, the controller 60 can check the state by referring to the history from the memory 63. When the white ink filled chamber is in the clear filled state (step S14: N), the controller 60 does nothing. However, when the white ink filled chamber is in the white filled state (step S14: Y), the controller 60 executes the clear switching (that is, sucks ink of 1 g after the toggle switch is operated) (step S16).

Effectivity of Printer 1 According to the Embodiment of the Invention

As described above, the white switching is executed as follows in the embodiment of the invention. Namely, the toggle switch 80 is operated so as to shift from the clear communication state to the white communication state, and then, ink for the first predetermined amount (3.3 g) is sucked (consumed) from the head 42. On the other hand, the clear switching is executed as follows. Namely, the toggle switch 80 is operated so as to shift from the white communication state to the clear communication state, and then, ink for the second predetermined amount (1 g) which is smaller than the first predetermined amount is sucked (consumed) from the head 42. That is, the controller 60 make the suction amount of ink at the time of the clear switching be smaller than that at the time of the white switching. This makes it possible to save clear ink.

In the existing example (comparative example), a difference is not particularly set between the suction amount of ink at the time of the white switching and that at the time of the clear switching. The suction amount has been determined (for example, determined to be 3.3 g) such that white ink in the head 42 is surely (completely) switched to clear ink (alternatively, clear ink in the head 42 is surely switched to white ink) in each switching.

In contrast, in the embodiment of the invention, the suction amount of ink at the time of the clear switching is made smaller than that at the time of the white switching, in view of the following matters. An object of the white switching is to execute the white color printing. Therefore, clear ink is required to be surely (completely) switched to white ink at the time of the white switching in consideration of prevention of the deterioration in image quality of an image obtained by the white color printing. Accordingly, it is not preferable that clear ink remain after the white switching, in terms of image quality. On the other hand, an object of the clear switching is to prevent the head from being clogged. Therefore, white ink is not necessarily required to be surely (completely) switched to clear ink at the time of the clear switching. It is because a function of the clear ink to prevent the head from being clogged is sufficiently realized even if some small amount of white ink remains. Accordingly, in the embodiment of the invention, the suction amount of ink at the time of the clear switching is made smaller than that at the time of the white switching, in view of the above viewpoints. This makes it possible to save clear ink.

Another Embodiment

In the above embodiment, a printing apparatus is mainly described. However, disclosures of a method of switching filled states and the like are included. Further, the above embodiment is described in order to make the invention understood easily and is not intended to limit the invention. It is needless to say that the invention can be changed or modified without departing from the scope of the invention and the equivalents thereof are included in the invention. In particular, the following embodiment is also included in the invention.

Further, the printing apparatus is embodied as an ink jet printer in the above embodiment. However, the invention is not limited thereto and can be applied to other printing apparatuses.

Moreover, in the method of switching ink according to the above embodiment, ink is sucked after the toggle switch 80 is toggled. However, the invention is not limited thereto. For example, flushing may be performed in place of the suction of ink after the toggle switch 80 is toggled. Alternatively, both the flushing and the suction of ink may be performed after the toggle switch 80 is toggled. In the above embodiment, the suction of ink is executed as an example way of consuming ink from the head 42. However, the way of consuming ink is not limited to the suction of ink and the flushing or both the flushing and the suction of ink may be executed, alternatively.

What is claimed is:

1. A printing apparatus comprising:

a head which discharges a plurality of color inks onto a medium and into which white ink and clear ink which is for preventing the head from being clogged are selectively filled;

a white ink container which contains the white ink;

a clear ink container which contains the clear ink;

a selection portion which communicates either of the white ink container or the clear ink container with the head; and a controller which executes a first switching from a second filled state where the head is filled with the clear ink to a first filled state where the head is filled with the white ink by operating the selection portion so as to shift from a state where the clear ink container is communicated with the head to a state where the white ink container is communicated with the head, and then, consuming ink for a first predetermined amount from the head, and which executes a second switching from the first filled state to the second filled state by operating the selection portion so as to shift from a state where the white ink container is communicated with the head to a state where the clear ink container is communicated with the head, and then, consuming ink for a second predetermined amount which is smaller than the first predetermined amount from the head.

2. A method of switching filled states comprising;

executing a first switching from a second filled state where a head, which discharges a plurality of color inks onto a medium and into which white ink and clear ink which is for preventing the head from being clogged are selectively filled, is filled with the clear ink to a first filled state where the head is filled with the white ink by operating a selection portion, which communicates either of a white ink container or a clear ink container with the head, so as to shift from a state where the clear ink container is communicated with the head to a state where the white ink container is communicated with the head, and then, consuming ink for a first predetermined amount from the head; and executing a second switching from the first filled state to the second filled state by operating the selection portion so as to shift from a state where the white ink container is communicated with the head to a state where the clear ink container is communicated with the head, and then, consuming ink for a second predetermined amount which is smaller than the first predetermined amount from the head.

* * * * *